United States Patent [19]

Anderson et al.

[11] Patent Number: 4,650,408

[45] Date of Patent: Mar. 17, 1987

[54] CONTINUOUS METAL EXTRUSION APPARATUS

[75] Inventors: Douglas E. Anderson, Canterbury; Keith J. Mitchell, Rochester, both of United Kingdom

[73] Assignee: Babcock Wire Equipment Limited, Kent, England

[21] Appl. No.: 746,466

[22] PCT Filed: Aug. 2, 1982

[86] PCT No.: PCT/GB82/00237

§ 371 Date: Mar. 25, 1983

§ 102(e) Date: Mar. 25, 1983

[87] PCT Pub. No.: WO83/00452

PCT Pub. Date: Feb. 17, 1983

Related U.S. Application Data

[63] Continuation of Ser. No. 482,998, Mar. 25, 1983, abandoned.

[30] Foreign Application Priority Data

Jul. 31, 1981 [GB] United Kingdom ..... 8123581

[51] Int. Cl.[4] ..... B22F 3/20; B21C 23/08

[52] U.S. Cl. ..... 425/79; 72/262; 425/224; 425/374; 425/376 A; 425/376 B

[58] Field of Search ..... 72/262, 268; 425/78, 425/79, 224, 374, 376 R, 376 A, 376 B

[56] References Cited

U.S. PATENT DOCUMENTS

| | | | |
|---|---|---|---|
| 3,765,216 | 10/1973 | Green | 425/224 |
| 3,872,703 | 3/1975 | Green | 72/262 |
| 4,041,745 | 8/1977 | Moreau | 425/224 |
| 4,044,587 | 8/1977 | Green et al. | 425/374 |
| 4,054,048 | 10/1977 | Hagerman | 72/262 |
| 4,055,979 | 11/1977 | Hunter et al. | 72/262 |
| 4,101,253 | 7/1978 | Etherington | 425/79 |
| 4,163,377 | 8/1979 | Moreau | 72/262 |
| 4,217,852 | 8/1980 | Nagai et al. | 72/262 |
| 4,362,485 | 12/1982 | Slater et al. | 425/79 |
| 4,397,622 | 8/1983 | Childs et al. | 72/262 |

FOREIGN PATENT DOCUMENTS

| | | | |
|---|---|---|---|
| 1535004 | 12/1978 | United Kingdom . | |
| 2028206 | 3/1980 | United Kingdom . | |
| 1566152 | 4/1980 | United Kingdom . | |
| 1574604 | 9/1980 | United Kingdom | 72/262 |
| 1590776 | 6/1981 | United Kingdom . | |
| 2069389 | 8/1981 | United Kingdom . | |
| 2087301 | 5/1982 | United Kingdom | 425/78 |
| 2089703 | 6/1982 | United Kingdom . | |

OTHER PUBLICATIONS

Research Disclosure, No. 203, Mar. 1981, (Havant, Hampshire, GB) Disclosure No. 20342 "Recent Developments in 'Conform'—Continuous Extrusion Technology", p. 137, right-hand column, lines 61-65.

*Primary Examiner*—Jay H. Woo
*Assistant Examiner*—James C. Housel
*Attorney, Agent, or Firm*—Solon B. Kemon

[57] ABSTRACT

Apparatus for continuous extrusion of metals in which feed is introduced into a circumferential groove 26 (FIG. 3) in a rotating wheel 2 to contact arcuate tooling 22 and an abutment 24. The abutment 4 is spaced from the walls of the groove 26 so that in operation a lining of the feed material is produced. Indentations 52 assist in holding the lining in place. The extrusion is generally in a radial direction through an aperture 58. The extrusion orifices (not shown) may be of part annular cross-section of different area. The extrusion aperture may extend from outside the groove 26 to permit of increased orifice area.

25 Claims, 7 Drawing Figures

CONTINUOUS METAL EXTRUSION APPARATUS

This application is a continuation of application Ser. No. 482,998 filed Mar. 25, 1983, now abandoned.

This invention relates to apparatus for the forming of metals by a continuous extrusion process and, more particularly, to a continuous extrusion process in which feed stock is introduced into a circumferential groove in a rotating wheel to pass into a passageway formed between the groove and arcuate tooling extending into the groove. The tooling includes a die or an extrusion orifice or extrusion orifices, extending in a generally tangential direction and leading to a die, and an abutment is provided extending into the groove to constrain the feedstock to flow through the die. The arcuate tooling and the abutment have a width substantially equal to the width of the groove.

According to one aspect of the invention there is provided continuous extrusion apparatus having a rotatable wheel formed with a circumferential groove, arcuate tooling bounding a radially outer portion of the groove provided with an exit aperture including a die or an extrusion orifice or extrusion orifices, extending in a generally radial direction from the groove and leading to a die, and an abutment extending into and spaced from wall portions of the groove adjacent to and displaced in the direction of rotation from the aperture partially to obturate the groove.

According to another aspect of the invention, there is provided continuous extrusion apparatus having a rotatable wheel formed with a circumferential groove, arcuate tooling bounding a radially outer portion of the groove provided with an exit aperture including a die or an extrusion orifice or extrusion orifices, extending in a generally radial direction from the groove and leading to a die, and an abutment extending into the groove adjacent to and displaced in the direction of rotation from the aperture partially to obturate the groove, the groove having side walls formed as annuli co-axial with the rotatable wheel.

According to a further aspect of the invention, the rotatable wheel is formed with a circumferential channel of substantially rectangular axial cross-section having wall portions formed by a cylindrical face bounded by radially outwardly extending flanges, the circumferential groove being formed in the cylindrical face of the circumferential channel and the arcuate tooling being formed with cylindrical and radial faces respectively co-acting with the wall portion of the circumferential channel.

According to a yet further aspect of the invention, there is provided continuous extrusion apparatus having a rotatable wheel formed with a circumferential groove, arcuate tooling bounding a radially outer portion of the groove formed with an extrusion orifice or extrusion orifices extending in a generally radial direction from the groove, an abutment extending into the groove adjacent to and displaced in the direction of rotation from the orifice or orifices partially to obturate the groove, the or each orifice including a passageway diverging away from the groove to an extrusion die.

The invention will now be described, by way of example, with reference to the accompanying, partly diagrammatic drawings, in which.

Figure 1:
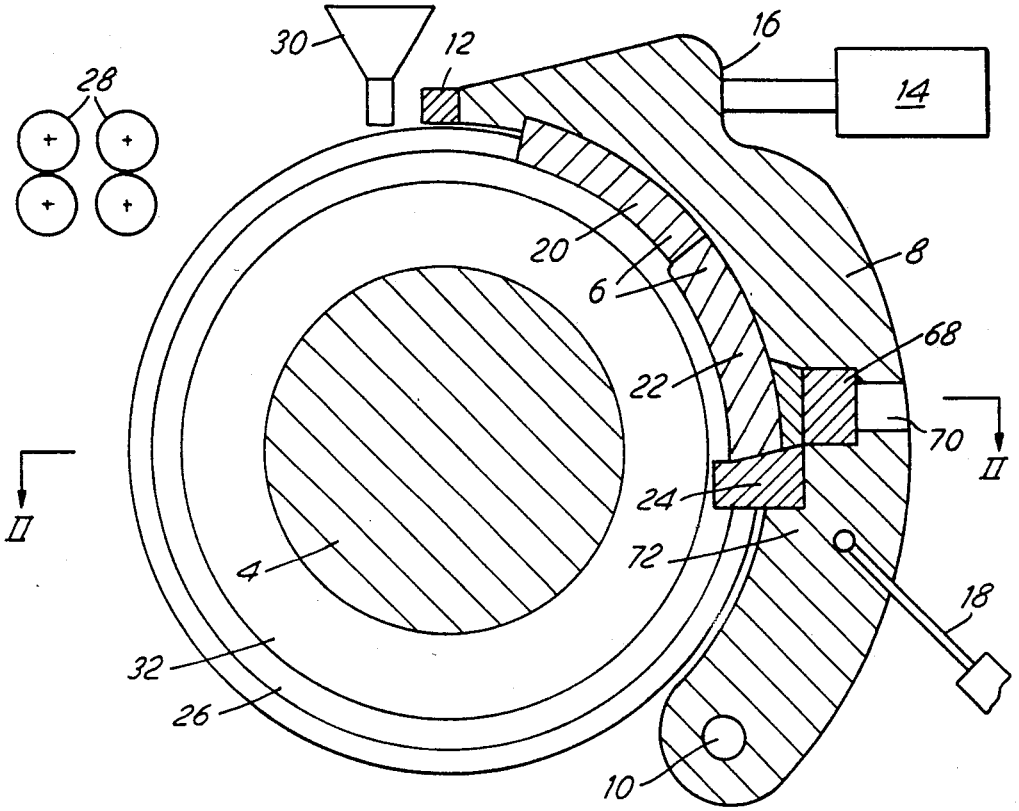
FIG. 1 is a cross-sectional side elevation of the forming apparatus.
Figure 2:
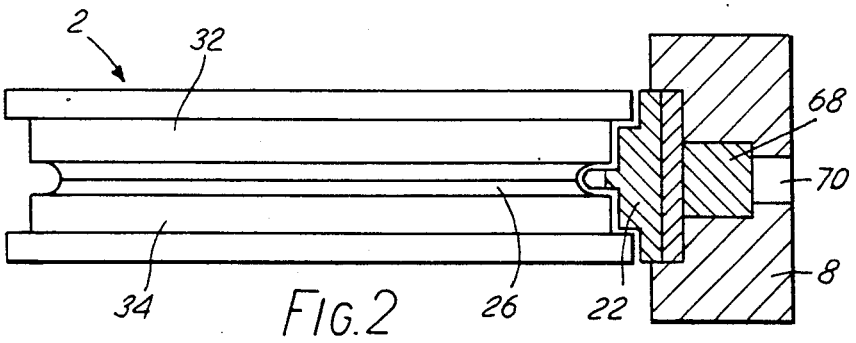
FIG. 2 is a partial axial cross-section taken on the line II—II of FIG. 1.

As shown in FIGS. 1 and 2, a circumferentially grooved wheel 2 is mounted on a horizontal drive shaft 4 running on bearings (not shown) positioned on a bed (not shown). Arcuate tooling 6 is positioned in a shoe 8 mounted on a pivot 10 extending parallel to the horizontal drive shaft 4 and urged against a stop 12 positioned adjacent the wheel 2 and above the drive shaft 4 by means of a main hydraulic ram 14 bearing against a shoulder 16 formed on the shoe. A support ram 18 is provided to pivot the shoe 8 into, or out of, registration with the wheel 2. The tooling 6 includes a shoe insert 20, a die top 22 and an abutment 24 positioned in the shoe 8 to register with the wheel. The shoe insert 20 serves, when the shoe is in position adjacent the stop, to form a closure to the adjacent portion of the circumferential groove 26 in the wheel as the wheel rotates past the shoe insert. The die top 22 forms a continuation of the shoe insert 20 and also forms a closure to the adjacent rotated portion of the circumferential groove. The abutment 24 extends into the circumferential groove 26 to form an obturation of the groove.

A series of straightening and forming rollers 28 are arranged to direct feed material in the form of a continuous rod or wire into the circumferential groove 26. Alternatively, for feed material in a particulate form, a hopper 30 is positioned above the circumferential groove to discharge thereto.

Figure 3:
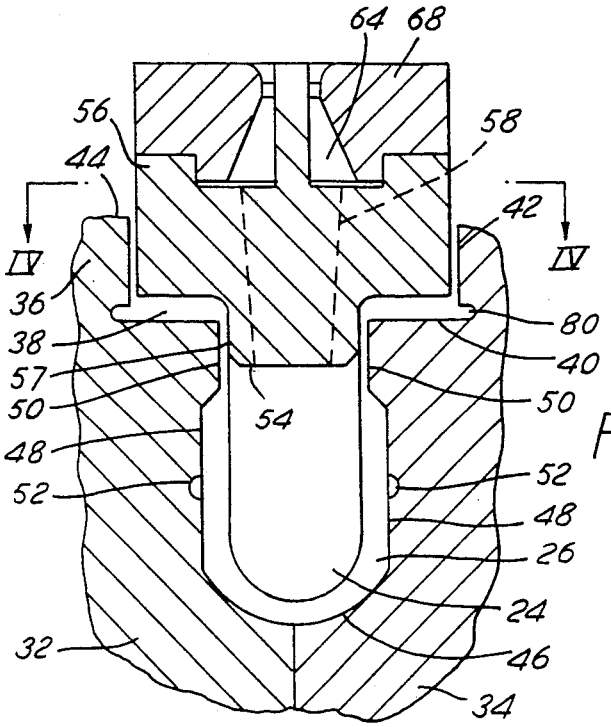
FIG. 3 is a cross-section of a portion of the forming apparatus.
Figure 4:
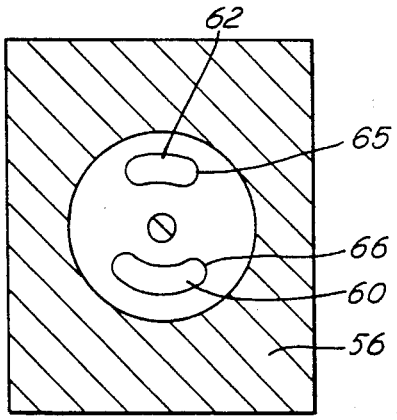
FIG. 4 is a cross-section corresponding to the line IV—IV of FIG. 3.

The circumferentially grooved wheel 2 is formed in two halves 32, 34, symmetrical about the central radial plane, clamped together between two hubs (not shown) on the drive shaft 4. As shown in FIG. 3, the rim 36 of the wheel is formed with a rectangular cross-section channel 38 having a cylindrical surface 40 bounded by annular faces 42, 44. The circumferential groove 26 is formed in the cylindrical surface 40 with a part torroidal radially inner portion 46 bounded by inner annuli 48 intersecting the torroidal portion and stepped toward the central plane at the radially outer parts thereof, by outer annuli 50. Hemispherical indentations 52 are made in the inner annuli 48 at equi-spaced angular intervals.

The die top 22 includes a convex surface 54 bounded by radially extending faces 56 making a sliding fit within the channel 38 of the rim of the wheel projecting as a tongue 57 into the circumferential groove 26 in the wheel by a uniform amount of approximately 2 mm. The convex surface 54 is penetrated by an exit aperture 58 constituting two orifices 60, 62 leading to an extrusion chamber 64.

The two exit orifices 60, 62 are of complementary cross-sections approximating to two diametrically opposed portions of an annulus, with ends 65, 66 of the portions being of semi-circular form joining the inner and outer boundaries of the annulus. The arcuate length of the respective portions is unequal in order to give unequal cross-sectional areas, but approximately equal stresses in the extruded material.

An extrusion die 68 is positioned in the shoe 8 in register with the die top 22 to receive material from the orifices 60, 62 and discharge through an aperture 70 in the shoe. The abutment 24 is positioned in the shoe 8 at the end portion 72 remote from the feed and extends into the groove 26 on the wheel with a clearance of approximately 1 mm over the radially outer annuli 50.

In operation, to produce copper or hard aluminium alloy hollow section extrusions, the appropriate set of tooling including a die top 22 having two exit orifices 60, 62 is mounted on the arcuate shoe 8, the shoe pivoted into contact with the wheel 2 and the main ram 14 positioned to apply force to the shoe. The drive to the wheel is then energised and powder, coarse granules and chippings of the feed material fed through the hopper 30 to the circumferential groove 26 whilst increasing the loading on the shoe until the material flows and forms a lining to the groove having an internal profile corresponding to that of the abutment 24. The material flows into the indentations 52 thereby assisting in the restraining of possible slippage between the lining and the wheel or disintegration of the lining. The material also flows into the necked portion of the groove bounded by the annuli 50 and between the shoe 8 and the wheel 2 to serve as a seal between the wheel and the shoe. Once the lining has been formed the hopper feed is discontinued, the hopper removed and solid bar stock fed through the rollers 28 into the groove. The feed is carried around with the wheel until the abutment 24 is encountered whereupon the material flows through the exit orifices 60, 62—which are sized to operate at substantially equal pressure drops or stress concentrations and thus, speeds of flow. The material flows into the extrusion chamber 64—where the two streams combine—and then flows to the die 68 for extrusion. In the case under consideration, where a hollow section extrusion is being produced, webs supporting a core piece of the die may be positioned in an unsymmetrical manner in order to stabilise the feed of material to the die and avoid surface discontinuities in the extrusion.

Figure 5:
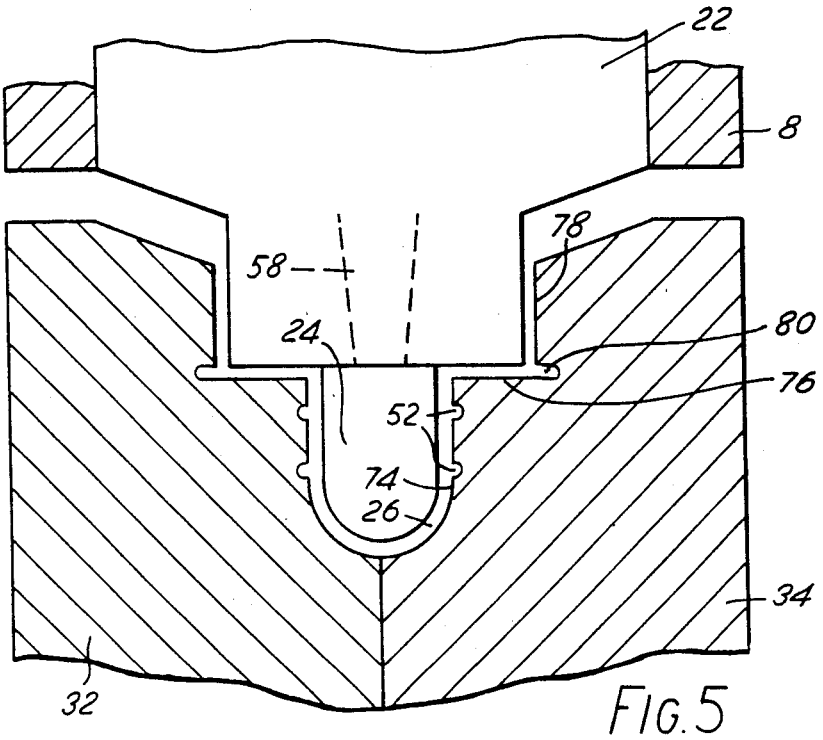
FIG. 5 is an alternative form of the portion shown in FIG. 3.

When extruding materials other than copper, it can be advantageous initially to feed copper material through the hopper 30 to the rotating circumferential groove 26 to form the lining and then feed the material to be extruded into the so lined groove.

Where aluminium material forms the feedstock, as shown in FIG. 5, the profile of the circumferential groove 26 may be simplified by omitting the radially outer annuli 50 such that the side walls 74 of the groove are planar.

The dimensions of the circumferential groove 26, the channel 38 and the tooling 6 are such that a land 76 of between approximately 3 and 5 mm is produced to either side of the groove in the channel and lands 78 of similar size are produced in the side flanges of the channel. A circumferential indentation 80 is formed at the junctions of the respective lands.

Figure 6:
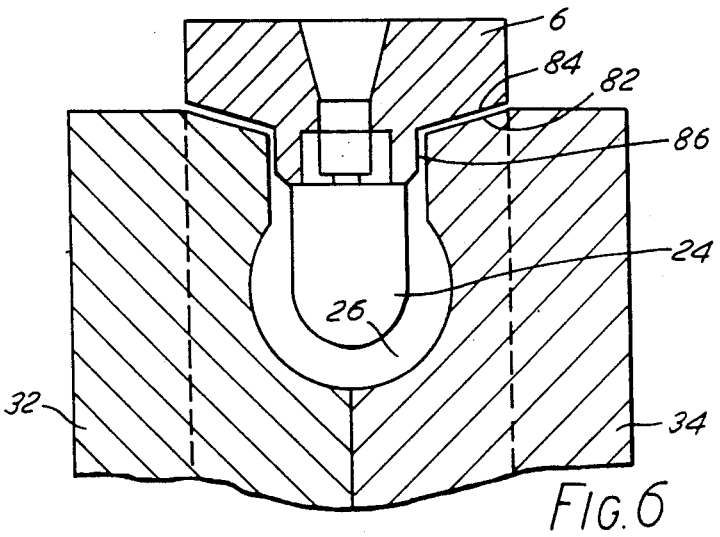
FIG. 6 is a further alternative form of the portion shown in FIG. 3.

It will be appreciated that the channel may take other cross-section forms such as, for example as shown in FIG. 6, a channel with frusto-conical walls 82 converging to the groove. The arcuate tooling 6 has a corresponding form with frusto-conical faces 84 intersecting a tongue 86 which penetrates into the groove, to a distance of between 2 mm and 5 mm, typically 3.5 mm. Alternatively, the arcuate tooling is formed with a cylindrical face registering with the junction of the frusto-conical walls and the groove in the wheel.

Figure 7:
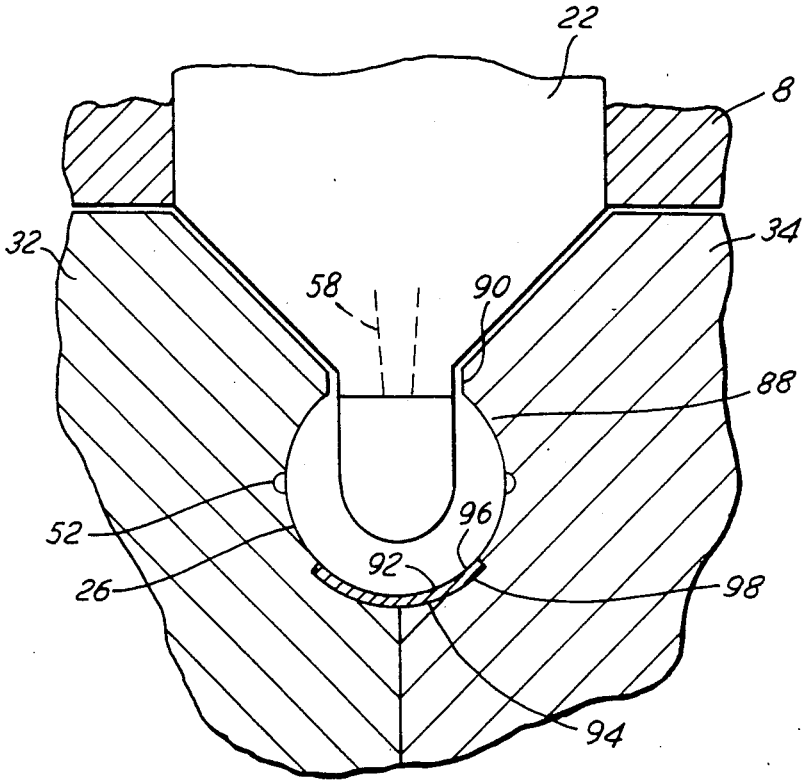
FIG. 7 is a yet further alternative form of the portion shown in FIG. 3.

It will also be appreciated that the circumferential groove may take other cross-sectional forms, such as, for example as shown in FIG. 7, cylindrically truncated torroidal—with the intersection between the torroidal face 88 and an imaginary cylinder coinciding with a lip 90 formed adjacent the base of the channel giving a 1 mm clearance with the abutment 24.

As a modification, as shown in FIG. 7, a thin, steel, liner 92 of part torroidal form may be positioned in the circumferential groove 26, which has a portion 94 machined away to accommodate the liner, prior to bringing the two halves 32, 34 of the wheel into contact. Circumferentially extending edge portions 96 of the liner are of slightly greater thickness than the remainder of the liner and are arranged to bear against the adjacent wall portions 98 of the groove. Upon feeding copper material into the rotating groove to form a lining, the liner is urged against the wall of the groove and the slightly greater thickness of the edge portions of the liner serve to effect a seal between the liner and the wall of the groove. The liner thus serves to constrain the copper feed material from flowing into the junction between the two halves of the circumferentially grooved wheel. As a further modification, (not shown) with such a liner, hemispherical indentations may be made in the wall of the liner at equi-spaced angular intervals.

As further modifications, the convex surface 54 of the die top 22 may either register flush with the base of the channel, in the manner indicated in FIG. 5, or may project into the groove 26 by an amount increasing curvilinearly or in steps along the circumferential length. Where the convex surface 54 extends flush with the base of the channel the exit aperture 58 may be sized on a basis of the full axial width of the convex surface when taking into account the stress arising adjacent the aperture when extruding. Where the convex surface 54 is stepped to project as a tongue into the circumferential groove in the wheel the exit aperture 58 must be of a lesser cross-sectional area since, for stressing considerations, the relevant width of the convex surface will correspond to the axial width across the circumferential groove.

When more than one exit orifice is provided, the orifices extending into an expansion chamber, it is also necessary to take into consideration when sizing the orifices the stress or pressure forces prevailing in the extruded material immediately adjacent the orifice in order to obtain appropriate flow rates—which for most extrusions would need to be equal—through the respective orifices. Of course, if desired, flow rates other than equal may be selected where required to achieve non-symmetrical combining in the extrusion chamber 64.

It will be appreciated that the wire feed may be omitted and the feed consist of granules fed through the hopper 30.

It will also be appreciated that in a modification (not shown) the exit aperture in the convex surface of the die top may be in the form of a die or, alternatively may constitute a single orifice leading to an extrusion chamber.

With some feed materials it may not be necessary to form a lining, as such, to the circumferential groove 26. In such an instance alternatively, the groove may be formed with a semi-toroidal radially inner portion bounded by radially extending annuli tangential to the semi-toroidal portion intersecting the base of the channel. With such an arrangement, a clearance of approximately 1 mm is formed between the walls of the groove and the abutment, and in operation, a lining to the groove is not, as such, formed. Feed is in the form of continuous rod or wire corresponding closely to the cross-sectional dimension of the circumferential groove.

Whilst hemispherical indentations have been indicated in the drawings, it will be appreciated that protrusions may equally be utilised to effect restraint upon movement of the liner. The disposition of the indentations, or protrusions, may take a variety of forms. For example in FIGS. 3 and 7 they are indicated as lying with centers pitched at equal intervals on a single imaginary circle centered on the wheels axis, whilst in FIG. 5 they are indicated as lying on with centers pitched at equal angular intervals alternately on first and second imaginary circles centered on the wheel axis with the first circle having a greater radius than the second circle.

We claim:

1. Continuous extrusion apparatus having a rotatable wheel formed with a circumferential groove, said circumferential groove including spaced side walls connected by a base, arcuate tooling bounding a radially outer arcuate portion of the groove, said arcuate tooling being provided with an exit aperture extending in a generally radial direction from the groove, the said exit aperture including a die or an extrusion orifice leading to a die or extrusion orifices leading to a die, and, an abutment positioned at a location adjacent to and displaced in the direction of rotation from said exit aperture, said abutment extending into the groove with side and base surfaces of the abutment adjacent the side walls and base of the groove being spaced substantially uniformly from the surface of the side walls and all of the surface of the base by a clearance of approximately one millimeter partially to obturate the groove.

2. Continuous extrustion apparatus as claimed in claim 1, characterised in that a multiplicity of spaced discrete indentations or protrusions are formed in at least one of the side walls of the groove.

3. Continuous extrusion apparatus as claimed in claim 2, characterized in that the discrete indentations or protrusions are positioned with centers pitched at equal intervals on an imaginary circle centered on the rotatable wheel axis and located intermediate a radially innermost portion and a radially outermost portion of the groove.

4. Continuous extrusion apparatus as claimed in claim 2, characterized in that the discrete indentations or protrusions are positioned with centers pitched at equal intervals alternately on first and second imaginary circles centered on the rotatable wheel axis with the first circle having a greater radius than the second circle and located intermediate a radially innermost portion and a radially outermost portion of the groove.

5. Continuous extrusion apparatus as claimed in claim 3 or claim 4, characterised in that the discrete indentations or protuberances are substantially hemi-spherical.

6. Continuous extrusion apparatus as claimed in claim 1 characterised in that the wheel is formed of two portions symmetrical and separable about a plane including a central circumferential axis of the groove.

7. Continuous extrusion apparatus as claimed in claim 1, characterized in that the side walls of the groove are formed as annuli co-axial with the rotatable wheel.

8. Continuous extrusion apparatus as claimed in claim 1, characterised in that the rotatable wheel is formed with a circumferential channel of substantially rectangular axial cross-section having wall portions formed by a cylindrical face bounded by radially outwardly extending flanges, the circumferential groove being formed in the cylindrical face of the circumferential channel and the arcuate tooling being formed with cylindrical and radial faces respectively co-acting with the wall portions of the circumferential channel.

9. Continuous extrusion apparatus as claimed in claim 8, characterised in that the junction between the cylindrical face and the radially outwardly extending flanges is formed with a circumferential indentation.

10. Continuous extrusion apparatus as claimed in claim 8, characterised in that the cylindrical face of the arcuate tooling is formed on a radius giving limited clearance with the cylindrical face of the circumferential channel.

11. Continuous extrusion apparatus as claimed in claim 1, characterised in that the arcuate tooling is formed with a tongue projecting into the circumferential groove.

12. Continuous extrusion apparatus as claimed in claim 11, characterised in that the tongue projects into the circumferential groove by increasing amounts around the groove toward the abutment.

13. Continuous extrusion apparatus as claimed in claim 12, characterised in that the tongue is formed with stepped increments in the amount of projection into the groove.

14. Continuous extrusion apparatus as claimed in claim 13, characterised in that a stepped increment in the amount of projection into the groove is formed adjacent the exit aperture.

15. Continuous extrusion apparatus as claimed in claim 1, characterized in that the or each orifice includes a passageway diverging away from the groove to the die.

16. Continuous extrusion apparatus as claimed in claim 15, characterised in that the or each passageway discharges to an extrusion chamber leading to the die.

17. Continuous extrusion apparatus as claimed in claim 1, characterised in that first and second orifices are formed in the arcuate tooling in register with a central radial plane of the circumferential groove each respectively extending by equal amounts to either side of the said plane and with the second orifice angularly displaced from the first orifice in the direction of rotation of the wheel and having a greater cross-sectional area than the first orifice.

18. Continuous extrusion apparatus as claimed in claim 17, characterised in that the first and second orifices have cross-sections corresponding to diametrically opposed portions of an annulus co-axial with the extrusion die.

19. Continuous extrusion apparatus as claimed in claim 1, characterised in that a plurality of orifices are formed in the arcuate tooling in register with the central plane of the circumferential groove each respectively extending by equal amounts to either side of the said plane and the depth of projection of the arcuate tooling into the groove is increased as a step intermediate adjacent orifices.

20. Continuous extrusion apparatus as claimed in claim 1, characterised in that the rotatable wheel is formed in two halves and a thin liner of part toroidal form is positioned in the circumferential groove to overlay the junction between the two halves of the wheel.

21. Continuous extrusion apparatus as claimed in claim 20, characterised in that circumferential recesses are formed in the two halves of the wheel to accommodate the liner and circumferentially extending edge portions of the liner are of slightly greater thickness than the remainder of the liner.

22. Continuous extrusion apparatus as claimed in claim 20 or claim 21, characterised in that the liner is formed with a multiplicity of spaced indentations or protrusions on a surface thereof remote from the circumferential groove.

23. Continuous extrusion apparatus as claimed in claim 1 wherein at least the base of the groove has a curved cross-section.

24. Continuous extrusion apparatus as claimed in claim 1 wherein the base of the groove is of semi-circular cross-section.

25. Continuous extrusion apparatus as claimed in claim 1 wherein the base of the groove and at least a portion of the side walls are of smoothly continuously curved cross-section.

* * * * *